US009293270B2

(12) United States Patent
Chen et al.

(10) Patent No.: US 9,293,270 B2
(45) Date of Patent: Mar. 22, 2016

(54) METHOD OF PREPARING AG-BASED OXIDE CONTACT MATERIALS WITH DIRECTIONALLY ARRANGED REINFORCING PARTICLES

(75) Inventors: Lesheng Chen, Yueqing (CN); Xiao Chen, Yueqing (CN); Gengxin Qi, Yueqing (CN); Chengfa Mu, Yueqing (CN)

(73) Assignee: Wenzhou Hongfeng Electrical Alloy Co., Ltd., Yueqing, Zhejiang (CN)

( * ) Notice: Subject to any disclaimer, the term of this patent is extended or adjusted under 35 U.S.C. 154(b) by 61 days.

(21) Appl. No.: 13/577,897

(22) PCT Filed: Apr. 11, 2011

(86) PCT No.: PCT/CN2011/000632

§ 371 (c)(1),
(2), (4) Date: Aug. 8, 2012

(87) PCT Pub. No.: WO2012/088734

PCT Pub. Date: Jul. 5, 2012

(65) Prior Publication Data

US 2013/0266791 A1 Oct. 10, 2013

(30) Foreign Application Priority Data

Dec. 30, 2010 (CN) ..... 2010 1 0620050

(51) Int. Cl.

| | |
|---|---|
| ***B22F 3/20*** | (2006.01) |
| ***H01H 1/0237*** | (2006.01) |
| ***C22C 5/06*** | (2006.01) |
| ***C22C 32/00*** | (2006.01) |
| ***B22F 3/04*** | (2006.01) |
| ***B22F 3/10*** | (2006.01) |
| ***B22F 3/14*** | (2006.01) |
| ***C22C 1/04*** | (2006.01) |
| ***C22C 49/02*** | (2006.01) |
| ***C22C 49/14*** | (2006.01) |

(52) U.S. Cl.

CPC ..... *H01H 1/0237* (2013.01); *B22F 3/04* (2013.01); *B22F 3/10* (2013.01); *B22F 3/14* (2013.01); *B22F 3/20* (2013.01); *C22C 1/0466* (2013.01); *C22C 5/06* (2013.01); *C22C 32/0021* (2013.01); *C22C 49/02* (2013.01); *C22C 49/14* (2013.01); *H01H 1/02372* (2013.01); *H01H 1/02374* (2013.01); *H01H 1/02376* (2013.01); *Y10T 428/249921* (2015.04)

(58) Field of Classification Search

CPC ..... B22F 3/04; B22F 3/20; B22F 3/24
See application file for complete search history.

(56) References Cited

U.S. PATENT DOCUMENTS

| | | | | | |
|---|---|---|---|---|---|
| 3,501,287 | A * | 3/1970 | Lever | ..... | 419/19 |
| 4,018,630 | A * | 4/1977 | Hill et al. | ..... | 419/21 |
| RE30,052 | E * | 7/1979 | Davies et al. | ..... | 75/234 |
| 4,609,525 | A * | 9/1986 | Schreiner et al. | ..... | 419/6 |
| 5,360,673 | A * | 11/1994 | Mayer et al. | ..... | 428/546 |
| 6,409,794 | B2 * | 6/2002 | Wolmer et al. | ..... | 75/232 |
| 7,566,437 | B2 * | 7/2009 | Goia et al. | ..... | 423/604 |

* cited by examiner

*Primary Examiner* — George Wyszomierski
*Assistant Examiner* — Ngoclan T Mai

(57) ABSTRACT

In the present invention, a method of preparing Ag-based oxide contact materials with directionally arranged reinforcing particles is disclosed, comprising steps of: a) preparing evenly dispersed composite powders by chemical co-precipitation method combining with roasting, b) granulating the composite powders by high energy ball milling, and sieving the powders, c) mixing the powders and Ag matrix in a powder mixing machine, d) cold isostatic pressing, e) sintering, f) hot-pressing, g) hot-extruding to obtain Ag-based oxide contact materials with directionally arranged reinforcing particles. This method can obtain particle reinforced Ag-based material with good electrical performance even when the reinforced (oxide) particles are very small. This method is simple, easy to operate, and does not require special equipment. The resistance to welding and arc erosion, electric conductivity and the processability of the material prepared through this present invention can be greatly improved.

8 Claims, No Drawings

METHOD OF PREPARING AG-BASED OXIDE CONTACT MATERIALS WITH DIRECTIONALLY ARRANGED REINFORCING PARTICLES

CROSS REFERENCE OF RELATED APPLICATION

This is a U.S. National Stage under 35 USC 371 of the International Application PCT/CN2011/000632, filed 11 Apr. 2011.

BACKGROUND OF THE PRESENT INVENTION

1. Field of Invention

This present invention relates to a preparation method of one contact material, more particularly to a method of preparing Ag-based oxide contact materials with directionally arranged reinforcing particles.

2. Description of Related Arts

Electrical contacts, one of the core components of electrical switches, are in charge of the connection and disconnection of electrical circuits and load current. The electrical contact materials are widely applied to the manufacture of both low and high voltage electrical apparatus including various air switches, relays and ac/dc contactors and covering a wide range of fields such as civil use, industry, military, aerospace, aviation and information. In recent years, with the development of the high voltage transmission and transformation grid towards large capacity and extra high voltage (EHV), there has been a high demand for the improvement of automatic level and sensitivity of the low voltage distribution system and control system and modernization of the electronic industrial products. As a result, there seems to be an increasingly high requirement on electrical contact material for more functions and longer service life. Therefore, researches on new Ag-based composites and preparation methods have been continuously carried out. Metallic oxide (MeO) particles reinforced Ag-based composite has been widely studied and applied due to its good thermal conductivity, electrical conductivity, resistance to welding and resistance to electrical wear. Meanwhile, as the preparation of metallic oxide (MeO) particle reinforced Ag-based composite could be achieved at a low cost and in a relatively simple preparation process such as the traditional metal working process, the development of the material seems to have a promising future.

Research results on the particle-reinforced Ag-based electrical contact materials are stated as below:

1) Chinese patent: preparation method of carbon-coated nickel nano-particle reinforced Ag-based composite, application number: 200810153154.9, publication number: CN101403105A.

2) Chinese patent: preparation method of metal matrix composite, application number: 200410064970.4, publication number: CN1760399A.

3) Chinese patent: preparation method of particle-reinforced metal matrix composite, application number: 200810018200.4, publication number: CN101285187A.

4) Chinese patent: preparation method of nano rare earth mixed with $AgSnO_2$ electrical contact alloy by chemical co-precipitation method, application number: 200410073547.0, publication number: CN100481289C.

At present, the preparation methods of particle-reinforced Ag-based electrical contact materials can be classified into three categories. First is the conventional powder metallurgy sintering method, whose process includes powder mixing→isostatic pressing→sintering→hot pressing→extruding, and secondary processing such as rolling or forging. During powder mixing of this method, the reinforced particles prone to clustering cannot be dispersively distributed thereby undermining the performance of the product. Second is to pre-process the reinforcing particles [literature 1], reinforcing particle-matrix [literature 2], or matrix [literature 3] based on the conventional method. Third is to prepare well distributed composite powder by chemical co-precipitation method [literature 4], and then process it with cold pressing, sintering, re-pressing and extruding. Despite that the second and third method can dispersedly distribute the reinforcing particles into the Ag matrix, study has shown that when the reinforcing particles (oxide) are small (nanoscale), the dispersed distribution can increase the contact area between the reinforcing particles and Ag matrix. Therefore, the electron scattering effect is greatly reinforced and electrical resistance of the contact materials can be greatly increased, which shall greatly affect the performance of the product. Meanwhile, the dispersively distributed small reinforcing particles (oxide) can improve the intensity and hardness of the material, and can improve resistance to mechanical wear of the material. However, it can also greatly decrease the elongation of the materials resulting in poor ductility and difficulty in processing.

SUMMARY OF THE PRESENT INVENTION

In order to overcome the drawbacks mentioned above, the present invention provides a preparation method of Ag-based oxide contact materials with directionally arranged reinforcing particles, which can obtain particle reinforced Ag based material with good electrical performance even when the reinforced phase (oxide) particles are very small. This method is simple, easy to operate, and places no particular requirement on the equipment. The resistance to welding and arc erosion, electrical conductivity and processability of the material can be greatly improved by means of the present invention.

In order to achieve the above objects, the present invention provides a preparation method of Ag-based oxide contact materials with directionally arranged reinforcing particles comprising steps of:

a) preparing mixed solution containing $Ag^+$ and reinforcing phase metal ion, adding co-precipitator while stirring, filtering out precipitate, washing and roasting the precipitate so as to obtain evenly dispersed composite powder, wherein the proportion of the $Ag^+$ and reinforcing phase metal ion is obtained by calculating the constituents of the composite powder to be prepared; the selected co-precipitator is one that can precipitate the solution of $Ag^+$ and reinforcing metal ion, and the obtained precipitate can be decomposed to metal oxide after roasting, wherein co-precipitator should be in sufficient amount so as to completely precipitate the solution of $Ag^+$ and reinforcing metal ion;

b) granulating the composite powder obtained in step a) by high energy ball milling, sieving the powders, reprocessing the powders that fail to be sieved, and sieving again;

c) mixing the powders granulated in step (b) and Ag matrix in a powder mixing machine, wherein the weight ratio of the granulated powders and the Ag matrix is calculated according to the material to be prepared;

d) pressing the powders obtained in step c) by cold isostatic pressing to obtain a green body;

e) sintering the green body obtained by cold isostatic pressing;

f) hot-pressing the green body after sintering;

g) hot-extruding the green body after hot-pressing, and obtaining Ag-based oxide contact materials with directionally arranged reinforcing particles Ag-based oxide contact material.

The reinforcing particles of Ag-based oxide contact materials with directionally arranged reinforcing particles prepared in the above-mentioned method are dispersedly distributed in the matrix with particles connecting with each other and directionally arranged, and the reinforcing material is a single type of material or a mixture of several materials.

Different from the traditional method of chemical co-precipitation combining with powder metallurgy of conventional material (that is composite precipitate prepared by chemical co-precipitation method→roasting→cold pressing→sintering→re-pressing→extruding), the present invention includes steps of preparing precipitate of $Ag^+$ solution and reinforcing metal ion solution through chemical co-precipitation, roasting the precipitate to obtain evenly dispersed Ag-based oxide composite powder, granulating the composite powder by high energy ball milling and sieving it to obtain the granulated composite powder, and evenly mixing the granulated composite powder and matrix Ag powder according to the constituents of material to be prepared, and cold isostatic pressing, sintering, hot pressing and hot extruding the mixture. The coated body flows with the softened Ag in the Ag matrix during the extruding process. The oxide reinforcing particles coated with Ag are easy to be pulled away directionally arranged along the extruding direction and connected with each other so as to form fiber-like structure. By preparing materials in this way, the reinforcing phase exists in the form similar to the fibrous structure where particles are aligned directionally and connected with each other. Compared with the contact materials reinforced by dispersed particles, the arc ablation resistance performance of the present invention can be increased by 10-20%; the electric conductivity along the extruding direction can be increased by 5-15%; the resistance to welding can be increased by 10-20%; and the electrical durability can be increased by 10-30%. The present invention presents a practical way to improve the processability of the materials, and can be applied to mass production.

DETAILED DESCRIPTION OF THE PREFERRED EMBODIMENT

A description of the technical solution of the present invention is presented as follows for better understanding of the present invention. As the following instructions are only to clarify the technical solution of the present invention without any restriction for the scope of the invention, the scope of protection of the present invention is subject to claims.

The present invention provides a method of preparing Ag-based oxide contact materials with directionally arranged reinforcing particles, which is suitable for the preparation of the ordinary particle-reinforced Ag-based composites. Through this method the particle reinforced Ag based materials with good electrical performance can be obtained even when the reinforced (oxide) particles are very small. The production process in this method is simple and is easy to operate. Besides, there are no particular requirements on the equipment. The resistance to welding and arc erosion, electric conductivity and the processing performance of the material prepared can be greatly improved in the present invention.

The reinforcing phase of the Ag-based oxide contact material prepared according to the present invention exists in the matrix with particles connected with each other and directionally arranged, and the reinforcing material can be a single type of material or a mixture of several materials. The material is prepared according to specific requirement of constituents.

In the present invention, there can be alternatives for the parameters of the processing operation such as chemical co-precipitation, high energy ball milling and sieving, powder mixing, cold isostatic pressing, sintering, hot pressing and hot extruding.

For example, in step a), firstly, prepare mixed solution containing $Ag^+$ and reinforcing metal ion, add co-precipitator while stirring, filter out precipitate, wash and roast the precipitate so as to obtain evenly dispersed composite powders. The proportion of $Ag^+$ and reinforcing metal ion is calculated according to the oxide taking up the composite powder from ¾ to ½ in weight. The co-precipitator is a precipitant which can precipitate the solution of $Ag^+$ and reinforcing phase metal ion and can be decomposed to metal oxide after roasting. The co-precipitator should be in sufficient amount so as to completely precipitate the solution of $Ag^+$ and reinforcing phase metal ion. The stirring speed is between 80 revolutions per minute and 120 revolutions per minute and the reaction time is between 2 and 4 hours. The roasting temperature is between 300° C. and 500° C. and the roasting time is between 1 and 5 hours.

In step b) granulate the composite powders obtained in step a) by high energy ball milling, sieve the powders, reprocess the powders that fail to be sieved, and sieve again. The rotating speed of ball mill is between 180 revolutions per minute and 350 revolutions per minute; the ball milling time is between 5 and 15 hours; ball-to-powder weight ratio is between 10 and 20; the number of sieving meshes is between 100 and 400.

In step c) mix the powders granulated in step (b) and Ag matrix in a powder mixing machine, wherein the weight ratio of the granulated powders and the Ag matrix is calculated according to the material to be prepared. The rotating speed of the mixing powder machine is between 20 revolutions per minute and 35 revolutions per minute; the mixing time is between 2 and 6 hours.

In step d) press the powders obtained in step c) by cold isostatic pressing to obtain green body. The pressure of isostatic pressing is between 100 and 500 Mpa.

In step e) sinter the green body obtained by cold isostatic pressing. The sintering temperature is between 600° C. and 800° C.; the sintering time is between 8 and 15 hours.

In step f) hot-press the green body after sintering. The hot-pressing temperature is between 500° C. and 900° C. The pressure of hot-pressing is between 300 and 700 Mpa and the hot-pressing time is between 5 min and 20 min.

In step g) hot-extrude the green body after hot-pressing to obtain the Ag-based oxide contact material with directionally arranged reinforcing particles. The temperature of the green body is between 700° C. and 900° C.; the extruding ratio is between 100 and 400; the extruding speed is between 5 and 15 cm/min; the preheating temperature of the extrusion die is between 300° C. and 600° C.

The present invention will be illustrated in detail with embodiments as below.

Embodiment 1

Prepare AgZnO (8) Contact Materials

Step a) dissolve 340 g $AgNO_3$ powder and 1512 g $Zn(NO_3)_2$ into 10 L deionized water forming homogeneous solution, marked with A; dissolve 1200 g precipitant $Na_2CO_3$ into 5 L deionized water, marked with B; add solution B into A slowly and stir it at a constant speed of 80 revolutions per minute; the reaction time is 4 hours and filter out the precipitate; wash and roast the precipitate at a temperature of 380° C. for 5 hours to obtain evenly dispersed composite powders.

Step b) granulate the composite powders obtained in step a) by high energy ball milling, sieve the powders, reprocess the powders that fail to be sieved, and sieve again. The rotating speed of ball milling is 180 revolutions per minute; the ball milling time is 15 hours; ball-to-powder weight ratio is 15; the number of sieving meshes is 200.

Step c) add the granulated powders in step (b) and 7236 g Ag matrix into a V-shaped powder mixing machine and mix them well. The rotating speed of the powder mixing machine is 20 revolutions per minute. Mix it for 6 hours.

Step d) add the powders obtained in step c) into a plastic tube with 9 cm in diameter and 20 cm at length, and subjecting it to cold isostatic pressing so as to obtain a green body; the pressure of the isostatic pressing is 100 Mpa.

Step e) sinter the green body obtained in step d) at a temperature of 600° C. for 15 hours.

Step f) hot-press the sintered green body at a temperature of 800° C. with a pressure of 700 MPa for 5 minutes.

Step g) hot-extrude the hot-pressed green body at a temperature of 800° C., with an extruding ratio of 324 and an extruding speed 8 cm/min; the preheating temperature of the extrusion is 600° C.

This embodiment finally obtains the material reinforced by directionally arranged ZnO particles, which is similar to the fiber-like structure of Ag ZnO(8), wherein ZnO fibrous structure is in the form of tiny ZnO particles that are directionally arranged and connected with each other. The tensile strength of the obtained material is 290 Mpa; the electrical resistivity along the extruding direction is 2.1 μΩ·cm; the hardness is 85 HV.

Embodiment 2

Prepare $AgSnO_2$(10) Contact Materials

Step a) dissolve 340 g $AgNO_3$ powders and 750 g $SnCl_4$ into 8 L deionized water forming homogeneous solution, marked with A; dissolve 1500 g precipitant $(NH_4)_2C_2O_4$ into 7 L deionized water, marked with B; add solution B into A slowly and stir it at a uniform speed of 120 revolutions per minute; the reaction time is 2 hours and filter out the precipitate; wash and roast the precipitate at a temperature of 300° C. for 1 hour to obtain evenly dispersed composite powder.

Step b) granulate the composite powders obtained in step a) by high energy ball milling, sieve the powders, reprocess the powders that fail to be sieved, and sieve again. The rotating speed of ball milling is 350 revolutions per minute; the ball milling time is 10 hours; the ball-to-powder weight ratio is 10; the number of sieving meshes is 300.

Step c) add the powders granulated in step (b) and 3689 g Ag matrix into a V-shaped powder mixing machine and mix them well. The rotating speed of the powder mixing machine is 30 revolutions per minute. Mix it for 4 hours.

Step d) add the powders obtained in step c) into a plastic tube with 9 cm in diameter and 15 cm at length, and press it by cold isostatic pressing to obtain a green body; the pressure of the isostatic pressing is 500 Mpa.

Step e) sinter the green body obtained in step d) at a temperature of 800° C. for 10 hours.

Step f) hot-press the sintered green body at a temperature of 800° C. with a pressure of 500 MPa for 10 minutes.

Step g) hot-extrude the hot-pressed green body at a temperature of 900° C., with an extruding ratio of 225 and an extruding speed 5 cm/min; the preheating temperature of the extrusion die is 500° C.

This embodiment finally obtains a material reinforced by directionally arranged $SnO_2$ particles, which is similar to the fiber like structure of $AgSnO_2$(10), wherein $SnO_2$ fibrous structure is in the form of many tiny $SnO_2$ particles that are directionally arranged and connected with each other. The tensile strength of the obtained material is 280 Mpa; the electrical resistivity along the extruding direction is 2.2 μΩ·cm; the hardness is 88 HV.

Embodiment 3

Prepare AgCdO12 Contact Materials

Step a) dissolve 510 g $AgNO_3$ powders and 600 g $Cd(NO_3)_2$ into 5 L deionized water forming homogeneous solution, marked with A; dissolve 800 g precipitant $Na_2CO_3$ into 5 L deionized water, marked with B; add solution B into A slowly and stir it at a uniform speed of 100 revolutions per minute; the reaction time is 2 hours and filter out the precipitate; wash and roast the precipitate at a temperature of 500° C. for 3 hours to obtain evenly dispersed composite powder.

Step b) granulate the composite powders obtained in step a) by high energy ball milling, sieve the powders, reprocess the powders that fail to be sieved and, sieve again. The rotating speed of ball milling is 300 revolutions per minute; the ball milling time is 5 hours; ball-to-powder weight ratio is 15; the number of sieving meshes is 100.

Step c) add the powders granulated in step (b) and 2062 g Ag matrix into a V-shaped powder mixing machine and mix them well. The rotating speed of the powder mixing machine is 35 revolutions per minute. Mix it for 2 hours.

Step d) add the powders obtained in step c) into a plastic tube with 9 cm in diameter and 15 cm at length, and press it by cold isostatic pressing to obtain a green body; the pressure of the isostatic pressing is 300 Mpa.

Step e) sinter the green body obtained in step d) at a temperature of 750° C. for 8 hours.

Step f) hot-press the sintered green body at a temperature of 500° C. with a pressure of 300 MPa for 20 minutes.

Step g) hot-extrude the hot-pressed green body forming a sheet at a temperature of 700° C., with an extruding ratio of 100 and an extruding speed 15 cm/min; the preheating temperature of the extrusion die is 300° C.

This embodiment finally obtains a material reinforced by directionally arranged CdO particles, which is similar to the fiber-like arrangement of AgCdO12, wherein CdO fibrous structure is in the form of many tiny CdO particles that are directionally arranged and connected with each other. The tensile strength of the obtained material is 285 Mpa; the electrical resistivity along the extruding direction is 2.1 μΩ·cm; the hardness is 83 HV.

Embodiment 4

Prepare Ag-4ZnO-8CdO Contact Materials

Step a) dissolve 510 g $AgNO_3$ powders, 252 g $Zn(NO_3)_2$ and 400 g $Cd(NO_3)_2$ into 10 L deionized water forming homogeneous solution, marked with A; dissolve 800 g precipitant $Na_2CO_3$ into 5 L deionized water, marked with B; add solution B into A slowly and stir it at a uniform speed of 80 revolutions per minute; the reaction time is 2 hours and filter out the precipitate; wash and roast the precipitate at a temperature of 500° C. for 4 hours to obtain evenly dispersed composite powder.

Step b) granulate the composite powders obtained in step a) by high energy ball milling, sieve the powders, reprocess the powders that fail to be sieved, and sieve again. The rotating speed of ball milling is 200 revolutions per minute; the ball milling time is 8 hours; ball-to-powder weight ratio is 20; the number of sieving meshes is 400.

Step c) add the powders granulated in step (b) and 2063 g Ag matrix into a V-shaped powder mixing machine and mix them well. The rotating speed of the powder mixing machine is 30 revolutions per minute. Mix it for 4 hours.

Step d) add the powders obtained in step c) into a plastic tube with 9 cm in diameter and 15 cm at length, and press it by cold isostatic pressing to obtain a green body; the pressure of the isostatic pressing is 500 Mpa.

Step e) sinter the green body obtained in step d) at a temperature of 800° C. for 12 hours.

Step f) hot-press the sintered green body at a temperature of 900° C. with a pressure of 700 MPa for 10 minutes.

Step g) hot-extrude the hot-pressed green body at a temperature of 900° C., with an extruding ratio of 400 and an extruding speed 5 cm/min; the preheating temperature of the extrusion die is 600° C.

This embodiment finally obtains a material reinforced by directionally arranged ZnO and CdO particles, which is similar to the fiber-like arrangement of Ag-4ZnO-8CdO contact material, wherein ZnO and CdO fibrous structure is in the form of many tiny ZnO and CdO particles that are directionally arranged and connected with each other. The tensile strength of the obtained material is 260 Mpa; the electrical resistivity along the extruding direction is 2.4 μΩ·cm; the hardness is 87 HV.

It should be understood that the embodiments presented above can only be taken as examples of the invention and are not intended to represent any restrictions for or limitations to the technical scope of the present invention. The present invention can be applied to the preparation of other Ag-based oxide contact materials with directionally arranged reinforcing particles by different composition ratio. Any modification within the principles of the present invention, equivalent replacement, and improvement shall be included within the scope of protection of the present invention.

What is claimed is:

1. A preparation method of a particle directional arrangement reinforced Ag-based oxide contact material comprising steps of:

a) preparing mixed solution containing Ag+ and reinforcing phase metal ion, adding co-precipitator while stirring, obtaining precipitate, washing and roasting the precipitate, and obtaining evenly dispersed composite powders, wherein the proportion of the Ag+ and reinforcing phase metal ion is obtained by calculating constituents of the composite powders to be prepared; the co-precipitator is a precipitant that can precipitate the solution of Ag+ and reinforcing phase metal ion, and the precipitate can be decomposed to metal oxide after roasting, wherein the co-precipitator should be in sufficient amount so as to completely precipitate the solution of Ag+ and reinforcing phase metal ion;

b) granulating the composite powders obtained in step a) by high energy ball milling, sieving the powder, reprocessing the powder that fail to be sieved, and sieving again;

c) mixing the powders granulated in step (b) and Ag matrix in a powder mixing machine, wherein the weight ratio of the granulated powders and the Ag matrix is calculated according to the material to be prepared;

d) pressing the powders obtained in step c) by cold isostatic pressing to obtain a green body;

e) sintering the green body obtained by cold isostatic pressing;

f) hot-pressing the sintered body; and g) hot-extruding the hot-pressed sintered body, and obtaining the Ag-based oxide contact material with directionally arranged reinforcing particles, wherein in step a) the proportion of Ag+ and reinforcing phase metal ion is calculated according to the oxide taking up the composite powder from ¾ to ½ in weight.

2. The preparation method according to claim 1, wherein in step c) the rotating speed of the mixing powder machine is between 20 revolutions per minute and 35 revolutions per minute; the mixing time is between 2 and 6 hours.

3. The preparation method according to claim 1, wherein in step d) the pressure of isostatic pressing is between 100 and 500 Mpa.

4. The preparation method according to claim 1, wherein in step e) the sintering temperature is between 600° C. and 800° C.; the sintering time is between 8 and 15 hours.

5. The preparation method according to claim 1, wherein in step f) the hot-pressing temperature is between 500° C. and 900° C.; the pressure of hot-pressing is between 300 and 700 Mpa; the hot-pressing time is between 5 min and 20 min.

6. The preparation method according to claim 1, wherein in step g) the temperature of the hot-pressed sintered body during the hot-extruding is between 700° C. and 900° C.; the extruding ratio is between 100 and 400; the extruding speed is between 5 and 15 cm/min; the preheating temperature of the extrusion is between 300° C. and 600° C.

7. A preparation method of a particle directional arrangement reinforced Ag-based oxide contact material comprising steps of:

a) preparing mixed solution containing Ag+ and reinforcing phase metal ion, adding co-precipitator while stirring, obtaining precipitate, washing and roasting the precipitate, and obtaining evenly dispersed composite powders, wherein the proportion of the Ag+ and reinforcing phase metal ion is obtained by calculating constituents of the composite powders to be prepared; the co-precipitator is a precipitant that can precipitate the solution of Ag+ and reinforcing phase metal ion, and the precipitate can be decomposed to metal oxide after roasting, wherein the co-precipitator should be in sufficient amount so as to completely precipitate the solution of Ag+ and reinforcing phase metal ion;

b) granulating the composite powders obtained in step a) by high energy ball milling, sieving the powder, reprocessing the powder that fail to be sieved, and sieving again;

c) mixing the powders granulated in step (b) and Ag matrix in a powder mixing machine, wherein the weight ratio of the granulated powders and the Ag matrix is calculated according to the material to be prepared;

d) pressing the powders obtained in step c) by cold isostatic pressing to obtain a green body;

e) sintering the green body obtained by cold isostatic pressing;

f) hot-pressing the sintered body; and g) hot-extruding the hot-pressed sintered body, and obtaining the Ag-based oxide contact material with directionally arranged reinforcing particles, wherein in step a) the stirring speed is between 80 revolutions per minute and 120 revolutions per minute; the reaction time is between 2 and 4 hours; the roasting temperature is between 300° C. and 500° C. and the roasting time is between 1 hour and 5 hours.

8. A preparation method of a particle directional arrangement reinforced Ag-based oxide contact material comprising steps of:

a) preparing mixed solution containing Ag+ and reinforcing phase metal ion, adding co-precipitator while stirring, obtaining precipitate, washing and roasting the precipitate, and obtaining evenly dispersed composite powders, wherein the proportion of the Ag+ and reinforcing phase metal ion is obtained by calculating constituents of the composite powders to be prepared; the co-precipitator is a precipitant that can precipitate the solution of Ag+ and reinforcing phase metal ion, and the precipitate can be decomposed to metal oxide after roasting, wherein the co-precipitator should be in sufficient amount so as to completely precipitate the solution of Ag+ and reinforcing phase metal ion;

b) granulating the composite powders obtained in step a) by high energy ball milling, sieving the powder, reprocessing the powder that fail to be sieved, and sieving again;

c) mixing the powders granulated in step (b) and Ag matrix in a powder mixing machine, wherein the weight ratio of the granulated powders and the Ag matrix is calculated according to the material to be prepared;

d) pressing the powders obtained in step c) by cold isostatic pressing to obtain a green body;

e) sintering the green body obtained by cold isostatic pressing;

f) hot-pressing the sintered body; and g) hot-extruding the hot-pressed sintered body, and obtaining the Ag-based oxide contact material with directionally arranged reinforcing particles, wherein in step b) a rotating speed of ball mill is between 180 revolutions per minute and 350 revolutions per minute; ball milling time is between 5 and 15 hours; ball-to-powder weight ratio is between 10 and 20; the number of sieving meshes is between 100 and 400.

* * * * *